US005819917A

United States Patent [19]

Nicholson

[11] Patent Number: 5,819,917

[45] Date of Patent: Oct. 13, 1998

[54] FLASHLIGHT ACCESSORY

[76] Inventor: Jerome Nicholson, 4673 S. 37th St., St Louis, Mo. 63116

[21] Appl. No.: 627,116

[22] Filed: Apr. 3, 1996

[51] Int. Cl.[6] ..... A45C 15/00

[52] U.S. Cl. ..... 206/38; 362/207; 206/37; 206/705; 206/418

[58] Field of Search ..... 362/207, 157, 362/208, 200; 206/705, 418, 573, 37, 38, 38.1

[56] References Cited

U.S. PATENT DOCUMENTS

| | | | |
|---|---|---|---|
| 1,576,700 | 3/1926 | Zieschang | 362/200 |
| 1,809,696 | 6/1931 | Heilweil | 206/37 |
| 2,298,042 | 10/1942 | Desimone | 362/207 |
| 2,358,820 | 9/1944 | Muldoon | 362/207 |
| 3,151,740 | 10/1964 | Simon | 206/37 |
| 3,306,266 | 2/1967 | McCunney | 206/37 |
| 3,651,983 | 3/1972 | Haugen | 220/339 |
| 4,066,077 | 1/1978 | Shamlian | 128/201.11 |
| 4,119,248 | 10/1978 | Butler et al. | 220/339 |
| 4,834,084 | 5/1989 | Walsh | 128/201.11 |
| 4,864,474 | 9/1989 | Maglica | 362/207 |
| 5,076,460 | 12/1991 | Hussell | 220/337 |
| 5,139,165 | 8/1992 | Hara | 220/337 |
| 5,188,450 | 2/1993 | Anderson | 206/573 |
| 5,278,739 | 1/1994 | Gammache | 362/207 |

*Primary Examiner*—Carroll B. Dority

[57] ABSTRACT

An accessory (10) for attachment to a flashlight (F). The accessory carries replacement batteries (B) and a replacement bulb (L) for the flashlight. A housing (12) may be either circular or rectangular in cross-section. The length of the housing corresponds to the total length of the batteries required to replace the flashlight batteries. One end (14) of the housing is closed, its other end (16) is open, and the interior of the housing is sized for the replacement batteries to fit within the housing. An end cap (20) fits over the open end of the housing. The cap includes an interior bracket (26) in which the replacement bulb is stored, and the cap is removable for removal of the replacement batteries or the bulb. A ring (36) on the housing attaches to a ring (R) or a washer (40) on the flashlight for attaching the accessory to the flashlight; or, alternately, to an article of clothing worn by the user. This allows the accessory to be conveniently carried with the flashlight.

9 Claims, 2 Drawing Sheets

FLASHLIGHT ACCESSORY

BACKGROUND OF THE INVENTION

This invention relates to flashlights, and more particularly, to a flashlight accessory for holding spare flashlight batteries and bulbs.

Flashlights are a commonplace. They are kept in the house, garage, car and workshop so as to be readily available in the event of an emergency or when someone needs to see something and normal illumination is not adequate. Since their use is primarily in these situations, it can be disconcerting to attempt to use a flashlight only to discover that the batteries are dead or that the flashlight bulb has burned out. Most people do not use a flashlight every day. Because of this, they either may forget where the batteries or bulb are kept, or may have forgotten to purchase replacements after the last spares were used. Even worse, is not having replacement batteries or a bulb readily available when the flashlight is being used well away from a ready source of spares, especially on a camping trip, a boat, etc. It would therefore be very helpful if spares could be kept near at hand so they are readily available whenever needed.

SUMMARY OF THE INVENTION

Among the several objects of the present invention may be noted the provision of an accessory for a flashlight to store spare batteries and bulbs for the flashlight;

- the provision of such an accessory to carry at least the same number of spare batteries as the flashlight uses, so all the batteries in the flashlight can be readily replaced with good batteries whenever the flashlight fails;
- the provision of such an accessory to be attachable to the flashlight for carrying with the flashlight, as well as attachable to a person's belt or other portion of their apparel so the accessory can travel with the person;
- the provision of such an accessory including an attachment for conveniently attaching the accessory to a flashlight, or to the user's belt or belt loop so the accessory is carried with the flashlight;
- the provision of such an accessory in which the flashlight has a screw on cap at each end, and the attachment is formed for securement to either end of the flashlight by removing the cap, installing a loop end of the attachment on the flashlight and then replacing the cap;
- the provision of such an accessory in which the flashlight has a ring formed on one end cap and the accessory is attachable to the ring;
- the provision of such an accessory which is of a light weight, yet rugged plastic material so the accessory is easy to carry but not prone damage if subjected to rough usage; and,
- the provision of such an accessory which is a low cost unit available in a wide range of sizes and colors.

In accordance with the invention, generally stated, an accessory attachable to a flashlight carries replacement batteries and bulbs for the flashlight. A housing of the accessory may be either circular or rectangular in cross-section, and the length of the housing corresponds to the total length of the number of batteries required to replace all of the flashlight batteries. One end of the housing is closed, its other end is open, and the interior of the housing is sized for the replacement batteries to fit within the housing. An end cap fits over the open end of the housing. The cap includes an interior bracket in which the replacement bulbs are stored. The cap is removable for removal of the replacement batteries or the bulb. A ring on the housing attaches to a ring or to a washer attached to the flashlight for attaching the accessory to the flashlight; or, alternately, to an article of the user's clothing. This allows the accessory to be conveniently carried with the flashlight. Other objects and features will be in part apparent and in part pointed out hereinafter.

BRIEF DESCRIPTION OF THE DRAWINGS

In the drawings.

Corresponding reference characters indicate corresponding parts throughout the drawings.

DESCRIPTION OF A PREFERRED EMBODIMENT

Figure 1:
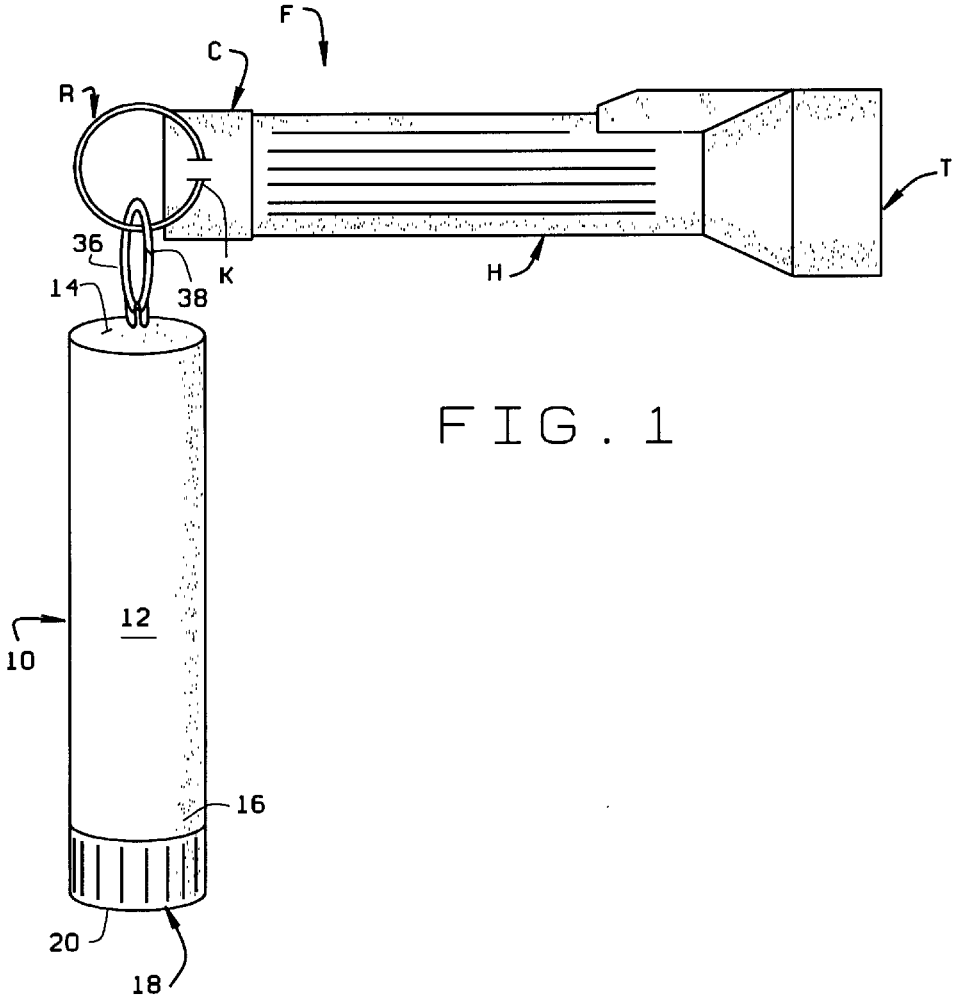
FIG. 1 is an elevational view of the accessory attached to a flashlight.

Referring to the drawings, a flashlight F is a hand held flashlight having a housing H in which one or more flashlight batteries are housed. It will be understood that the size and number of batteries will vary upon the type of flashlight. That is, a flashlight capable of throwing a more powerful beam will be a higher power unit using more or larger batteries than a less powerfull flashlight. A screw type cap C fits over one end of the housing to enclose the batteries. As shown in FIG. 1, the cap may include a bracket K with an attached ring R. At the other end of the housing is mounted the lamp unit T which comprises a housing in which a flashlight bulb L is installed. The backwall of the housing is typically coated with a reflective material, and a clear cover fits over the outer end of the unit.

Figure 2:
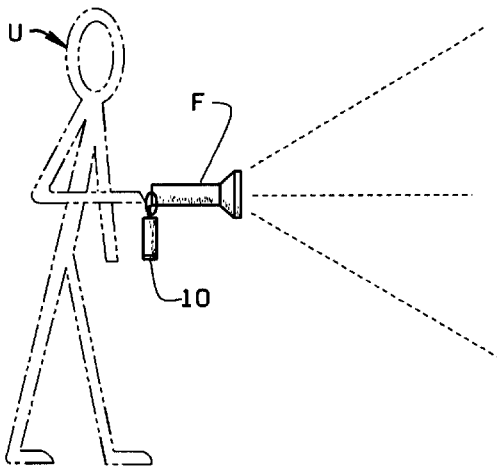
FIG. 2 illustrates a person carrying a flashlight with the accessory attached.
Figure 3:
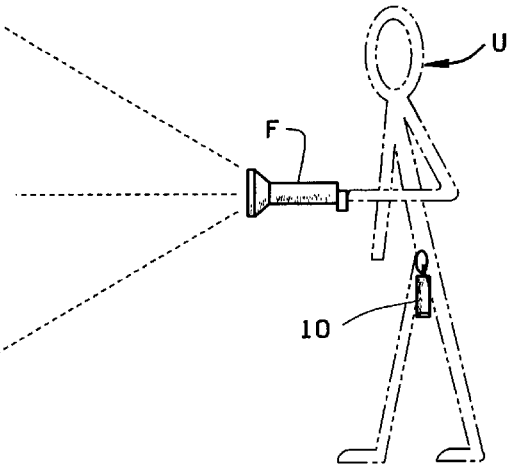
FIG. 3 illustrates the person with the accessory attached to his or her belt.
Figure 4:
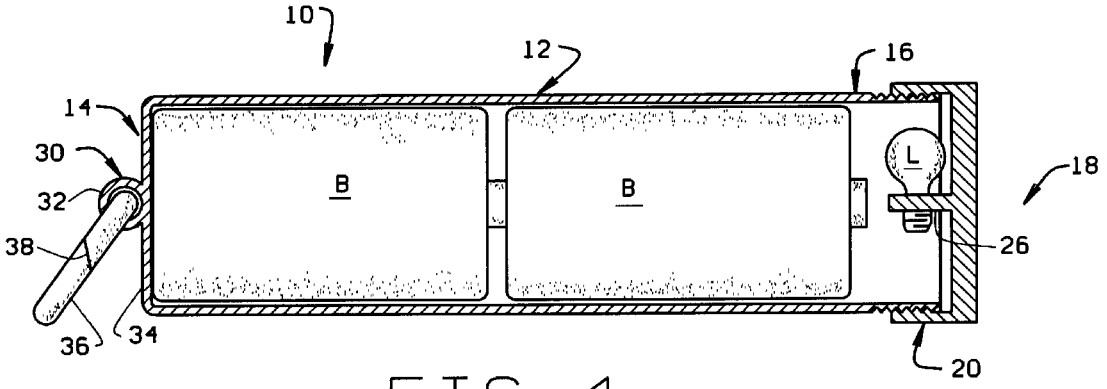
FIG. 4 is a cross-sectional view of the accessory.
Figure 8:
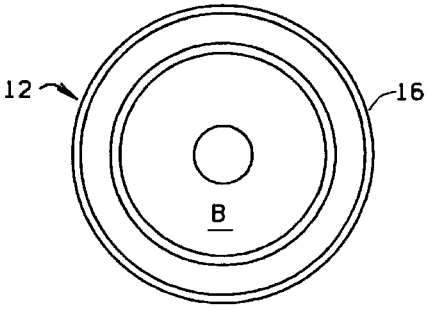
FIG. 8 is an end view of a first embodiment of the accessory.

An accessory 10 of the present invention is shown in FIG. 1. The attachment carries replacement batteries and a replacement bulb for the flashlight. As described hereinafter, the accessory may either be attached to the flashlight so as to dangle from one end of the flashlight when it is carried by a user U (see FIG. 2). Alternately, the accessory can be attached to the user's belt, a belt loop, or other convenient portion of the user's apparel so the accessory can be carried by the user (see FIG. 3). The accessory first includes a housing 12. The length of the housing corresponds to the total length of the batteries B required to completely replace the batteries currently used in the flashlight. In FIG. 4, two batteries B can fit within the housing. However, if the flashlight with which the accessory is used requires only one battery, then the housing could be shorter. Conversely, if the flashlight used more batteries, the housing would be longer. Further, the cross section of the housing can be circular (see FIG. 8) so to accommodate round batteries B. Or, a housing 12' can be rectangular in cross-section to accommodate rectangular batteries B'. Typically, the round batteries are the C and D type batteries; while the rectangular batteries are larger (9 volt) batteries.

Figure 9:
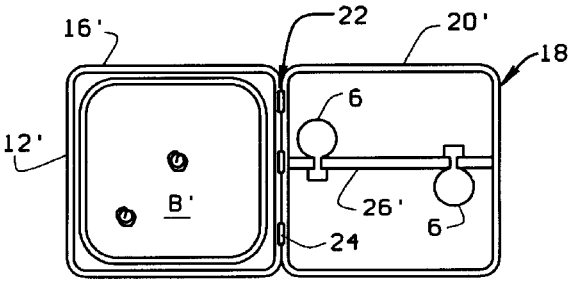
FIG. 9 is an end view of a second embodiment thereof.

Housing 12 or 12' is closed at one end (end 14 in FIG. 4) and open at its other end 16 or 16'. As noted, the interior of the housing is sized for replacement batteries B or B' to fit within the housing. A cap means 18 closes the open end of the housing, the cap means being removable for removal of the replacement batteries. In FIG. 4, end 16 of the housing is on the exterior threaded an the exterior. An end cap 20 is threadably received onto this end of the housing to enclose the batteries. Referring to FIG. 9, a hinge means 22 includes a hinge 24 formed adjacent the open end of the housing. Cap means 18 now includes a cap 20' which is a rectangular cap also attached to the hinge so the cap can cover the end of the housing. The height of the cap is greater than the size of a light bulb L. A bracket 26, 26' is formed on the inside of the cap and extends across the cap from one side to the other. Spaced openings 28 are formed in the bracket, and light bulbs L are fitted into these openings and are held in place by the bracket. Thus when the cap closes the open end of the housing, the replacement bulb is also stored inside the housing. It will be understood that the housing and end cap are of a electrically non-conductive, lightweight, sturdy material. To help prevent the batteries stored in the housing from prematurely discharging, the accessory does not include any electrical conductors which would form an electrical circuit with the stored batteries. Further, the housing and end cap are available in a variety of colors which may complement or contrast with each other, or with the flashlight.

Figure 5:
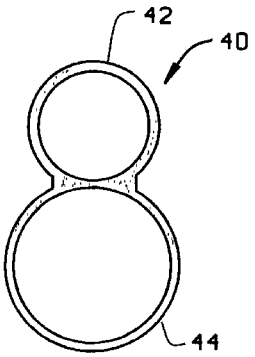
FIG. 5 is an elevational view of an attachment for attaching the accessory to a flashlight.
Figure 6:
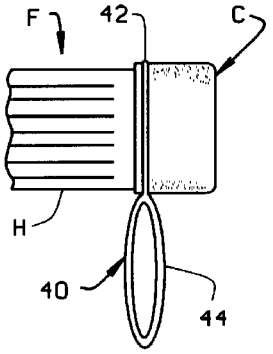
FIG. 6 is an installed view of the attachment on one end of the flashlight.
Figure 7:
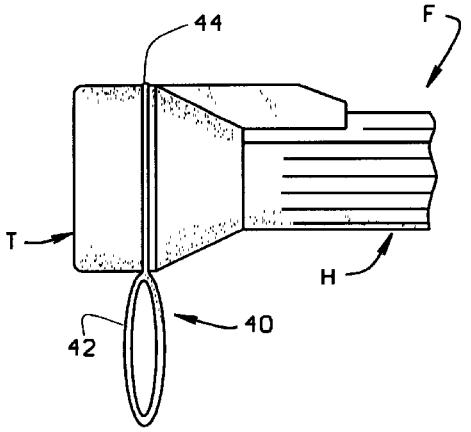
FIG. 7 is a similarly installed view of the attachment at the other end of the flashlight.

A means 30 is also provided for attaching accessory 10 to flashlight F, or to an article of user's clothing. In FIG. 4, means 30 includes a bracket 32 formed on the outside wall 34 of the closed end of the housing. A ring 36 having a slit 38 is captured in the bracket. As shown in FIG. 1, ring 36 can be slipped onto ring R of the flashlight to clip the flashlight and accessory together. Or, ring 36 can be slipped about a belt loop or belt worn by the user to conveniently connect the two together as shown in FIG. 3. However, if ring R is missing, or the flashlight does not include a ring or bracket, means 30 still enables the accessory to be attached to the flashlight. Referring to FIG. 5–7, means 30 includes a washer means 40 having a first washer 42, and a second washer 44. The respective washer 42 and 44 are round washers that are commonly connected together as shown in FIG. 5. Washer 42 has an inner diameter which allows it to be fitted onto one end of the housing when cap C is removed. When fitted in place, the washer is captured by reinstalling the cap. Washer 44 has a larger inner diameter than washer 42, and fits over the other end of the housing when the lamp unit is removed. Again, when fitted in place, washer 44 is captured by reinstalling the lamp unit. Once installed, ring 36 attaches to the other washer to connect the accessory and flashlight together.

What has been described is an accessory for a flashlight. The accessory is used to store spare batteries and bulbs for the flashlight. Conveniently, the accessory carries as many spare batteries as the flashlight uses, so all the flashlight batteries can be replaced at the same time. The accessory attaches either to the flashlight so it can be carried with the flashlight; or, it can be attachable to a person's belt as well. An attachment is provided for attaching the accessory to a flashlight or the user's belt or belt loop so the accessory is carried with the flashlight. The attachment fits on either end of the flashlight by securement with the cap piece on that end of flashlight. Or, if the flashlight has a ring formed on one end cap, the accessory is attachable to that ring. Finally, the accessory is of a light weight, rugged plastic construction and is available in a variety of sizes and colors.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. An accessory for attachment to a flashlight for carrying one or more replacement batteries and a replacement bulb for the flashlight comprising:

a housing the length of which corresponds to the total length of the batteries required to completely replace the batteries in the flashlight, the housing being electrically non-conductive, closed at one end, open at the other end, and having an interior sized for a plurality of replacement batteries to fit within the housing;

cap means closing the open end of the housing, said cap means being electrically non-conductive and removable from the housing for removal of the replacement batteries, said cap means including a cap fitting over the open end of the housing;

means storing a replacement light bulb in the housing to replace a burned out flashlight bulb; said storing means including a bracket formed on the inside of the cap, said bracket having a pair of openings formed therein for receiving two replacement bulbs; and means on the housing for attaching the accessory to the flashlight or to an article of clothing worn by the user for the accessory to be conveniently carried with the flashlight.

2. The accessory of claim 1 wherein said housing is circular in cross-section having an inner diameter corresponding to the diameter of a circular shaped replacement battery.

3. The accessory of claim 1 wherein said open end of said housing is externally threaded and said cap means includes a cap having interior threads for screwing the cap onto the housing to close the housing.

4. The accessory of claim 1 wherein said attachment means includes an attachment bracket formed on the outer face of the closed end of the housing, and a ring fitting through an opening in said bracket, said ring having a slot therein by which said ring can be fitted in a belt loop so the user of the accessory can carry the accessory.

5. The accessory of claim 1 wherein the attachment means includes a washer means securable to the accessory for the accessory to be attached to the flashlight for carrying therewith.

6. The accessory of claim 5 wherein said flashlight has a removable cap at one end for replacing the flashlight batteries, and said washer means includes a first washer having an inner diameter sized for the washer to fit over the end of the flashlight when the cap is removed for the first washer to be secured in place when the cap is replaced for the accessory to be carried with the flashlight.

7. The accessory of claim 6 wherein said flashlight has a removable end piece in which said flashlight bulb is enclosed, and said washer means includes a second washer having an inner diameter sized for the washer to fit over the end of the flashlight when the end piece is removed for the second washer to be secured in place when the end piece is replaced for the accessory to be carried with the flashlight.

8. The accessory of claim 7 wherein said first washer is of a different diameter than said second washer, and said first and second washers are connected together.

9. The accessory of claim 1 wherein said housing and said cap means are of a rugged, light weight plastic material.

* * * * *